US008384370B2

(12) United States Patent
Nakashimo

(10) Patent No.: US 8,384,370 B2
(45) Date of Patent: Feb. 26, 2013

(54) VOLTAGE REGULATOR WITH AN OVERCURRENT PROTECTION CIRCUIT

(75) Inventor: Takao Nakashimo, Chiba (JP)

(73) Assignee: Seiko Instruments Inc., Chiba (JP)

( * ) Notice: Subject to any disclaimer, the term of this patent is extended or adjusted under 35 U.S.C. 154(b) by 392 days.

(21) Appl. No.: 12/709,784

(22) Filed: Feb. 22, 2010

(65) Prior Publication Data

US 2010/0213909 A1 Aug. 26, 2010

(30) Foreign Application Priority Data

Feb. 23, 2009 (JP) ..... 2009-039340
Jan. 15, 2010 (JP) ..... 2010-007380

(51) Int. Cl.
*G05F 3/16* (2006.01)
*G05F 3/20* (2006.01)
*G05F 1/573* (2006.01)

(52) U.S. Cl. ..... 323/316; 323/277; 323/317

(58) Field of Classification Search ..... 323/271, 323/272, 277, 315–317
See application file for complete search history.

(56) References Cited

U.S. PATENT DOCUMENTS

| | | | | |
|---|---|---|---|---|
| 5,745,000 | A * | 4/1998 | Boerstler et al. | 327/543 |
| 6,720,754 | B2 * | 4/2004 | Nakashimo | 323/282 |
| 7,411,376 | B2 * | 8/2008 | Zhang | 323/277 |
| 2002/0118002 | A1 * | 8/2002 | Luo | 323/316 |
| 2003/0011952 | A1 * | 1/2003 | Fukui | 361/93.1 |
| 2008/0265853 | A1 * | 10/2008 | Chen et al. | 323/280 |

FOREIGN PATENT DOCUMENTS

JP 2003-216252 A 7/2003

* cited by examiner

*Primary Examiner* — Adolf Berhane
*Assistant Examiner* — Gary Nash
(74) *Attorney, Agent, or Firm* — Brinks Hofer Gilson & Lione

(57) ABSTRACT

Provided is a voltage regulator in which a maximum output current and a short-circuit output current may be accurately set. As a circuit for determining respective current values of a maximum output current (Im) and a short-circuit output current (Is) of an overcurrent protection circuit, the voltage regulator includes a current mirror circuit for mirroring a current in accordance with an output current so as to be capable of current control, without employing a resistor for converting a current into a voltage. Therefore, the maximum output current (Im) and the short-circuit output current (Is) may be accurately set with respect to an output current (Iout).

8 Claims, 7 Drawing Sheets

VOLTAGE REGULATOR WITH AN OVERCURRENT PROTECTION CIRCUIT

RELATED APPLICATIONS

This application claims priority under 35 U.S.C. §119 to Japanese Patent Application Nos. 2009-039340 filed on Feb. 23, 2009 and 2010-007380 filed on Jan. 15, 2010, the entire contents of which are hereby incorporated by reference.

BACKGROUND OF THE INVENTION

1. Field of the Invention

The present invention relates to a voltage regulator including an overcurrent protection circuit.

2. Description of the Related Art

A conventional voltage regulator is described. FIG. 3 is a diagram illustrating the conventional voltage regulator.

When an output voltage Vout is higher than a predetermined voltage, that is, when a divided voltage Vfb of a voltage dividing circuit 91 is higher than a reference voltage Vref, an output signal of an amplifier 92 (gate voltage of an output transistor 84) is so high that the output transistor 84 approaches an OFF state. Then, the output voltage Vout decreases. On the other hand, when the output voltage Vout is lower than the predetermined voltage, in a similar way to the above, the output voltage Vout increases. Thus, the output voltage Vout becomes constant.

In this case, it is assumed that an output terminal and a ground terminal of the voltage regulator are short-circuited. Then, an output current Iout increases to a maximum output current Im. In accordance with the maximum output current Im, a current flowing through a sense transistor 83, which is current-mirror-connected with the output transistor 84, increases. On this occasion, a P-type metal oxide semiconductor (PMOS) transistor 82 is in an ON state, and hence a voltage generated across a resistor 87 alone increases so that an N-type metal oxide semiconductor (NMOS) transistor 85 approaches an ON state. Then, a voltage generated across a resistor 86 increases so that a PMOS transistor 81 approaches an ON state. Then, a gate-source voltage of the output transistor 84 decreases so that the output transistor 84 approaches the OFF state. Accordingly, the output current Iout is prevented from exceeding the maximum output current Im and is fixed to the maximum output current Im, and hence the output voltage Vout decreases. In this case, based on the voltage generated across the resistor 87 alone, the gate-source voltage of the output transistor 84 decreases so that the output transistor 84 approaches the OFF state and the output current Iout is fixed to the maximum output current Im. Therefore, the maximum output current Im is determined based on a resistance value of the resistor 87 alone.

When the output voltage Vout decreases, and then a gate-source voltage of the PMOS transistor 82 becomes lower than an absolute value Vtp of its threshold voltage, the PMOS transistor 82 is turned OFF. Then, a voltage generated across not the resistor 87 alone but both the resistors 87 and 88 increases so that the NMOS transistor 85 further approaches the ON state. Then, the voltage generated across the resistor 86 further increases so that the PMOS transistor 81 further approaches the ON state. Then, the gate-source voltage of the output transistor 84 further decreases so that the output transistor 84 further approaches the OFF state. Accordingly, the output current Iout reduces to a short-circuit output current Is. After that, the output voltage Vout decreases to 0 V. In this case, based on the voltage generated across both the resistors 87 and 88, the gate-source voltage of the output transistor 84 decreases so that the output transistor 84 approaches the OFF state and the output current Iout becomes the short-circuit output current Is. Therefore, the short-circuit output current Is is determined based on resistance values of both the resistors 87 and 88 (see, for example, JP 2003-216252 A (FIG. 5)).

In the conventional technology, in order to accurately set the maximum output current Im and the short-circuit output current Is with respect to the output current Iout, a trimming process for the resistance values of both the resistors 87 and 88 is required because the maximum output current Im and the short-circuit output current Is are determined based on the resistance values of both the resistors 87 and 88. As a result, there arises a problem that a manufacturing process for the voltage regulator may be complicated correspondingly thereto.

SUMMARY OF THE INVENTION

The present invention has been made in view of the problem described above, and provides a voltage regulator in which a maximum output current and a short-circuit output current may be accurately set with ease.

In order to solve the problem described above, the present invention provides a voltage regulator including an overcurrent protection circuit, which includes a current mirror circuit for mirroring a current in accordance with an output current so as to be capable of current control, as a circuit for determining respective current values of a maximum output current Im and a short-circuit output current Is of the overcurrent protection circuit.

In order to determine the respective current values of the maximum output current Im and the short-circuit output current Is, the voltage regulator including the overcurrent protection circuit of the present invention is provided with the current mirror circuit for mirroring the current in accordance with the output current. Therefore, the maximum output current Im and the short-circuit output current Is may be accurately set with respect to the output current.

DETAILED DESCRIPTION OF THE PREFERRED EMBODIMENTS

Hereinafter, embodiments of the present invention are described with reference to the accompanying drawings.

First Embodiment

Figure 1:
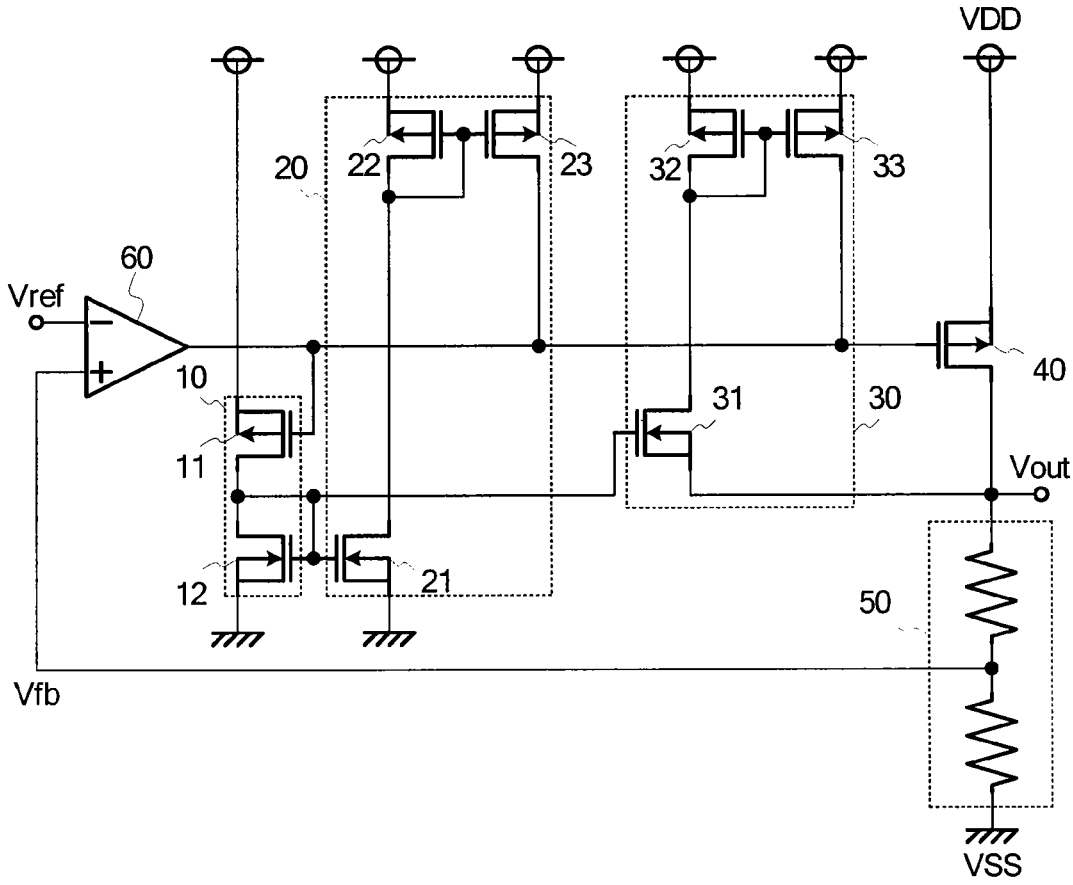
FIG. 1 is a circuit diagram illustrating a voltage regulator according to a first embodiment of the present invention.

First, a configuration of a voltage regulator according to a first embodiment of the present invention is described. FIG. 1 is a circuit diagram illustrating a voltage regulator according to the first embodiment of the present invention.

The voltage regulator includes a sense circuit 10, a control circuit 20, a control circuit 30, an output transistor 40, a voltage dividing circuit 50, and an amplifier 60.

The sense circuit 10 includes a sense transistor 11 and an N-type metal oxide semiconductor (NMOS) transistor 12. The control circuit 20 includes P-type metal oxide semiconductor (PMOS) transistors 22 and 23 and an NMOS transistor 21. The control circuit 30 includes PMOS transistors 32 and 33 and an NMOS transistor 31.

A non-inverting input terminal of the amplifier 60 is connected to an output terminal of the voltage dividing circuit 50, an inverting input terminal thereof is connected to a reference voltage input terminal, and an output terminal thereof is connected to an input terminal of the sense circuit 10, an output terminal of the control circuit 20, an output terminal of the control circuit 30, and a gate of the output transistor 40. A source and a back gate of the output transistor 40 are connected to a power supply terminal, and a drain thereof is connected to an output terminal of the voltage regulator. The voltage dividing circuit 50 is provided between the output terminal of the voltage regulator and a ground terminal thereof.

A gate of the sense transistor 11 is connected to the output terminal of the amplifier 60, and a source and a back gate thereof are connected to the power supply terminal. A gate of the NMOS transistor 12 is connected to a drain thereof, a gate of the NMOS transistor 21, a gate of the NMOS transistor 31, and a drain of the sense transistor 11. A source and a back gate of the NMOS transistor 12 are connected to the ground terminal. A gate of the PMOS transistor 22 is connected to a drain thereof, a gate of the PMOS transistor 23, and a drain of the NMOS transistor 21. A source and a back gate of the PMOS transistor 22 are connected to the power supply terminal A source and a back gate of the PMOS transistor 23 are connected to the power supply terminal, and a drain thereof is connected to the output terminal of the amplifier 60. A source and a back gate of the NMOS transistor 21 are connected to the ground terminal. A gate of the PMOS transistor 32 is connected to a drain thereof, a gate of the PMOS transistor 33, and a drain of the NMOS transistor 31. A source and a back gate of the PMOS transistor 32 are connected to the power supply terminal A source and a back gate of the PMOS transistor 33 are connected to the power supply terminal, and a drain thereof is connected to the output terminal of the amplifier 60. A source and a back gate of the NMOS transistor 31 are connected to the output terminal of the voltage regulator.

The PMOS transistor 22 and the PMOS transistor 23 are current-mirror-connected. The PMOS transistor 32 and the PMOS transistor 33 are current-mirror-connected. The output transistor 40 and the sense transistor 11 are current-mirror-connected. The NMOS transistor 12, which allows a current to flow through the sense transistor 11, is current-mirror-connected with the NMOS transistor 21 and the NMOS transistor 31.

The voltage dividing circuit 50 divides an output voltage Vout to output a divided voltage Vfb. The amplifier 60 makes a comparison between a reference voltage Vref and the divided voltage Vfb and controls a gate voltage of the output transistor 40 so that the output voltage Vout becomes constant. The output transistor 40 outputs the output voltage Vout based on an output signal of the amplifier 60 and a power supply voltage VDD. The sense circuit 10 senses an output current Iout of the output transistor 40 by the sense transistor 11. When the output current Iout becomes a maximum output current Im, the control circuit 20 operates so that the output transistor 40 approaches an off state, based on a current flowing through the NMOS transistor 21. When the output current Iout becomes the maximum output current Im, and then the output voltage Vout becomes equal to or lower than a predetermined voltage Va, the control circuit 30 operates so that the output transistor 40 further approaches the OFF state in order that the output current Iout becomes a short-circuit output current Is, based on a current flowing through the NMOS transistor 31.

Figure 2:
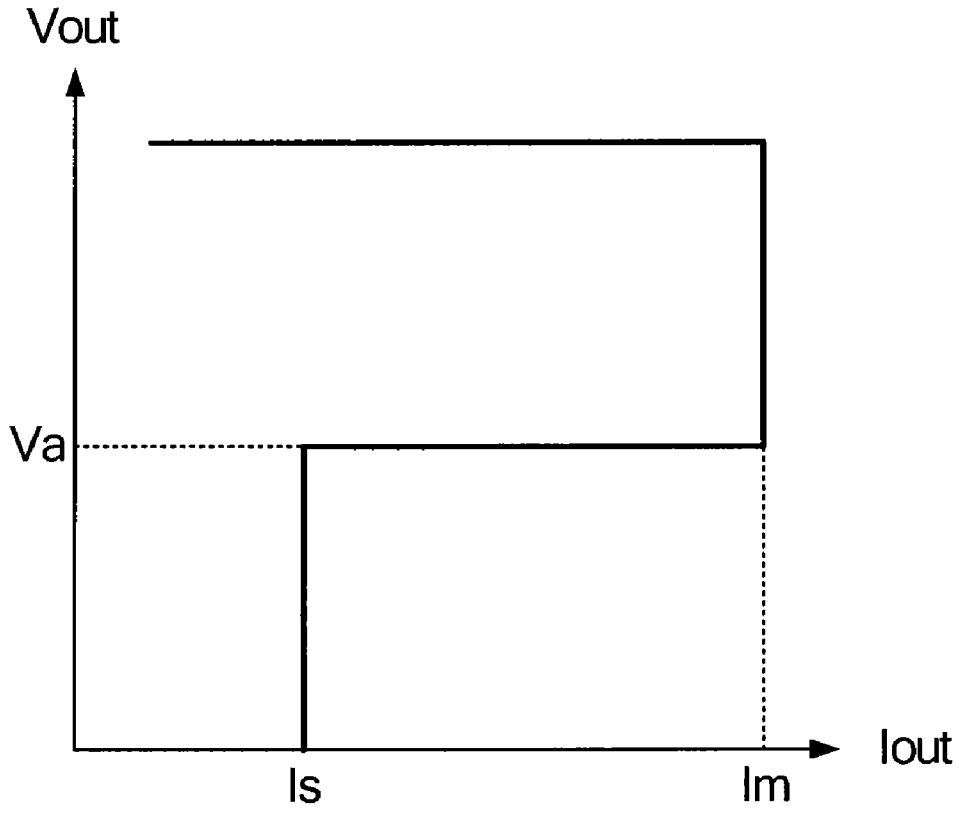
FIG. 2 is a graph illustrating output voltage-output current characteristics of the voltage regulator.
Figure 3:
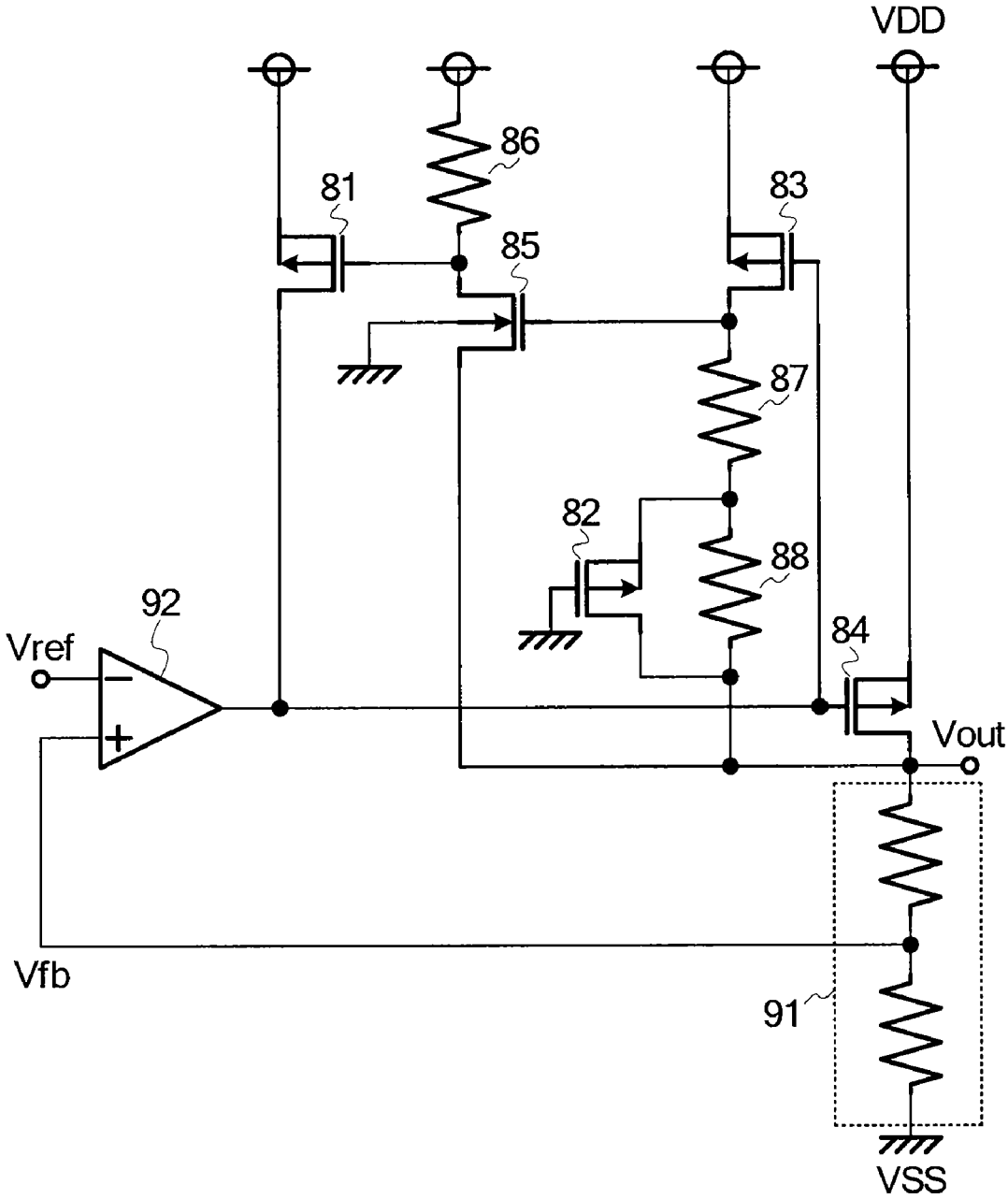
FIG.3 PRIOR ART
FIG. 3 is a circuit diagram illustrating a conventional voltage regulator.

Next, an operation of the voltage regulator is described. FIG. 2 is a graph illustrating output voltage-output current characteristics of the voltage regulator.

When the output voltage Vout is higher than a predetermined voltage, the divided voltage Vfb is higher than the reference voltage Vref, and the output signal of the amplifier 60 (gate voltage of the output transistor 40) is so high that the output transistor 40 approaches the OFF state. Then, the output voltage Vout decreases. On the other hand, when the output voltage Vout is lower than the predetermined voltage, an operation reversed from the operation described above is performed to increase the output voltage Vout. Thus, the output voltage Vout becomes constant.

In this case, if the output terminal and the ground terminal of the voltage regulator are short-circuited, the output current Iout increases. When the output current Iout becomes the maximum output current Im, the current flowing through the sense transistor 11, which is current-mirror-connected with the output transistor 40, increases in accordance with the maximum output current Im, and then a current flowing through the NMOS transistor 12 also increases. The current flowing through the NMOS transistor 21, which is current-mirror-connected with the NMOS transistor 12, also increases, and then a current flowing through the PMOS transistor 22 also increases. An ON-state resistance of the PMOS transistor 23, which is current-mirror-connected with the PMOS transistor 22, decreases so that a gate-source voltage of the output transistor 40 decreases and the output transistor 40 approaches the OFF state. Accordingly, the output current Iout is prevented from flowing exceeding the maximum output current Im, and hence the output voltage Vout decreases. In this case, based on the current flowing through the NMOS transistor 21, the gate-source voltage of the output transistor 40 decreases so that the output transistor 40 approaches the OFF state and the output current Iout is fixed to the maximum output current Im. Therefore, the maximum output current Im is determined based on the current flowing through the NMOS transistor 21.

The output voltage Vout decreases to be equal to or lower than the predetermined voltage Va. Then, a gate-source voltage of the NMOS transistor 31 becomes equal to or higher than its threshold voltage Vtn, and accordingly the NMOS transistor 31 is turned ON. Then, a current flowing through the PMOS transistor 32 increases to decrease an ON-state resistance of the PMOS transistor 33, which is current-mirror-connected with the PMOS transistor 32. Then, the gate-source voltage of the output transistor 40 further decreases so that the output transistor 40 further approaches the OFF state. Accordingly, the output current Iout reduces to the short-circuit output current Is. The short-circuit output current Is is determined based on the current flowing through the NMOS transistor 31. After that, the output voltage Vout decreases to 0 V. In this case, based on the current flowing through the NMOS transistor 31, the gate-source voltage of the output transistor 40 decreases so that the output transistor 40 approaches the OFF state and the output current Iout becomes the short-circuit output current Is. Therefore, the short-circuit output current Is is determined based on the current flowing through the NMOS transistor 31.

With this configuration, the output transistor 40 and the sense transistor 11 are current-mirror-connected, and in addition, the NMOS transistor 12, which allows a current to flow through the sense transistor 11, is current-mirror-connected with the NMOS transistor 21 and the NMOS transistor 31. Therefore, without the need for a trimming process for a resistance value of a resistor or the like, based on current mirror ratios of those transistors, the currents flowing through the NMOS transistor 21 and the NMOS transistor 31 are accurately set with respect to the output current Iout flowing through the output transistor 40. In other words, the maximum output current Im and the short-circuit output current Is are respectively determined based on the currents flowing through the NMOS transistor 21 and the NMOS transistor 31, and hence the maximum output current Im and the short-circuit output current Is are accurately set with respect to the output current Iout.

Further, no resistor is included in each of the control circuit 20 and the control circuit 30, and hence a trimming process for a resistance value of the resistor to be included therein is unnecessary. Therefore, a fuse to be used for the trimming process is also unnecessary, and hence the voltage regulator is reduced in size.

Note that, although not illustrated, instead of forming the current mirror connection of the PMOS transistor 22 and the PMOS transistor 23, the PMOS transistor 23 may be replaced with a circuit for applying, to the gate of the PMOS transistor 22, such a voltage as to allow the PMOS transistor 22 to operate in a linear region. The same holds true for the PMOS transistor 32 and the PMOS transistor 33.

Further, in FIG. 1, the back gate of the NMOS transistor 31 is connected to the output terminal of the voltage regulator. Alternatively, although not illustrated, the back gate thereof may be connected to the ground terminal. In this case, the NMOS transistor 31 becomes less likely to be turned ON, and fine adjustment is made to a waveform of FIG. 2 in accordance with the modification on the NMOS transistor 31.

Second Embodiment

Figure 4:
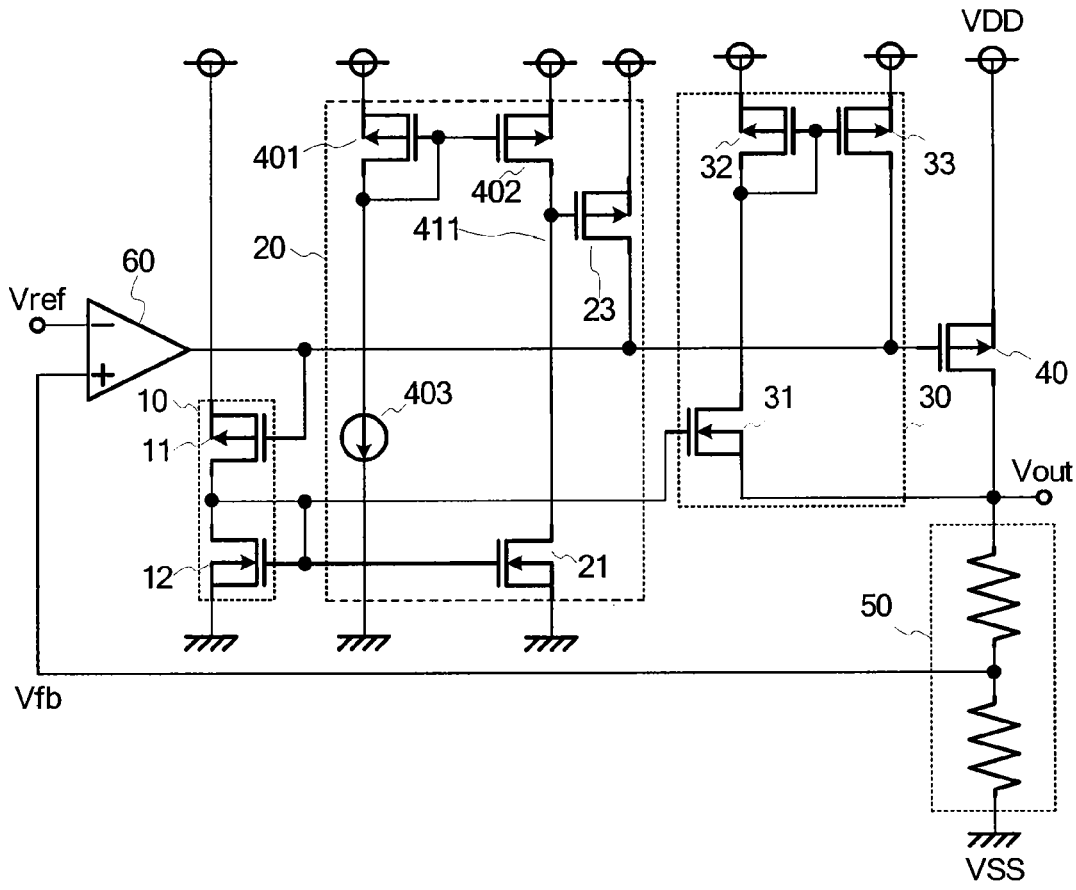
FIG. 4 is a circuit diagram illustrating a voltage regulator according to a second embodiment of the present invention.

FIG. 4 is a circuit diagram illustrating a voltage regulator according to a second embodiment of the present invention.

A difference from FIG. 1 resides in that the PMOS transistor 22 is eliminated while PMOS transistors 401 and 402 and a bias current source 403 are added. Connection is made such that one terminal of the bias current source 403 is connected to the ground terminal and another terminal thereof is connected to a drain of the PMOS transistor 401. The PMOS transistor 401 has a gate and the drain which are connected to a gate of the PMOS transistor 402, and a source connected to the power supply terminal. The PMOS transistor 402 has a drain connected to the gate of the PMOS transistor 23 and the drain of the NMOS transistor 21, and a source connected to the power supply terminal.

Next, an operation of the voltage regulator according to the second embodiment is described.

When the output voltage Vout is higher than a predetermined voltage, the divided voltage Vfb is higher than the reference voltage Vref, and the output signal of the amplifier 60 (gate voltage of the output transistor 40) is so high that the output transistor 40 approaches the OFF state. Then, the output voltage Vout decreases. On the other hand, when the output voltage Vout is lower than the predetermined voltage, an operation reversed from the operation described above is performed to increase the output voltage Vout. Thus, the output voltage Vout becomes constant.

When the output voltage is constant, the bias current source 403 allows a current to flow through the PMOS transistor 401. The PMOS transistor 401 and the PMOS transistor 402 have a current mirror configuration, and hence a current flows through the PMOS transistor 402. Then, a voltage around the power supply voltage VDD is generated at a node 411. Because the node 411 has the voltage around the power supply voltage VDD, the PMOS transistor 23 is in an OFF state.

In this case, if the output terminal and the ground terminal of the voltage regulator are short-circuited, the output current Iout increases. When the output current Iout becomes the maximum output current Im, the current flowing through the sense transistor 11, which is current-mirror-connected with the output transistor 40, increases in accordance with the maximum output current Im, and then the current flowing through the NMOS transistor 12 also increases. Then, the current flowing through the NMOS transistor 21, which is current-mirror-connected with the NMOS transistor 12, also increases. On this occasion, when the current flowing through the NMOS transistor 21 becomes larger in amount than the current flowing through the PMOS transistor 402, the voltage at the node 411 changes from the voltage around the power supply voltage VDD to a voltage around a ground voltage VSS. When the node 411 has the voltage around the ground voltage VSS, the PMOS transistor 23 approaches the ON state, and the gate-source voltage of the output transistor 40 decreases. In this way, the output transistor 40 approaches the OFF state.

The output transistor 40 and the sense transistor 11 are current-mirror-connected. In addition, the NMOS transistor 12 and the NMOS transistor 21 are current-mirror-connected. Therefore, based on current mirror ratios of those transistors, the current flowing through the NMOS transistor 21 may be set to have an accurate ratio with respect to the output current Iout. The maximum output current Im is determined based on the current flowing through the NMOS transistor 21 and the current flowing through the PMOS transistor 402. Therefore, the maximum output current Im may be adjusted with ease by adjusting values of those two currents.

As described above, according to the voltage regulator of the second embodiment, the maximum output current Im may be set and adjusted with ease based on the current flowing through the NMOS transistor 21 and the current flowing through the PMOS transistor 402.

Third Embodiment

Figure 5:
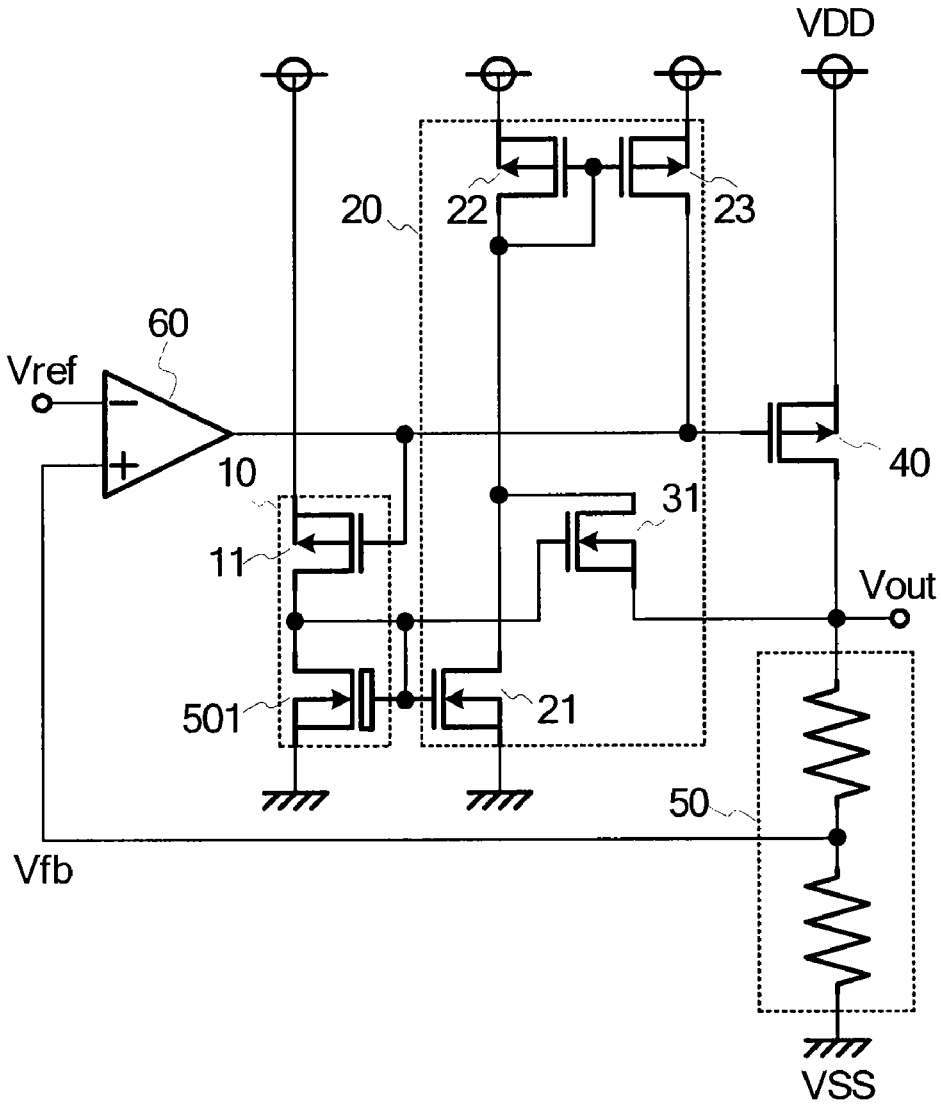
FIG. 5 is a circuit diagram illustrating a voltage regulator according to a third embodiment of the present invention.

FIG. 5 is a circuit diagram illustrating a voltage regulator according to a third embodiment of the present invention.

A difference from FIG. 1 resides in that the PMOS transistors 32 and 33 and the NMOS transistor 12 are eliminated while an NL transistor 501 is added. Connection is made such that a gate and a drain of the NL transistor 501 are connected to the gate of the NMOS transistor 21 and the gate of the NMOS transistor 31, and a source thereof is connected to the ground terminal. The NMOS transistor 31 has the drain connected to the drain of the NMOS transistor 21 and the drain and the gate of the PMOS transistor 22. The NMOS transistor 31 has the source connected to the output terminal.

Next, an operation of the voltage regulator according to the third embodiment is described. The NL transistor refers to a transistor having a threshold lower than that of an NMOS transistor.

When the output voltage Vout is higher than a predetermined voltage, the divided voltage Vfb is higher than the reference voltage Vref, and the output signal of the amplifier 60 (gate voltage of the output transistor 40) is so high that the output transistor 40 approaches the OFF state. Then, the output voltage Vout decreases. On the other hand, when the output voltage Vout is lower than the predetermined voltage, an operation reversed from the operation described above is performed to increase the output voltage Vout. Thus, the output voltage Vout becomes constant.

In this case, if the output terminal and the ground terminal of the voltage regulator are short-circuited, the output current Iout increases. When the output current Iout becomes the maximum output current Im, the current flowing through the sense transistor 11, which is current-mirror-connected with the output transistor 40, increases in accordance with the maximum output current Im. Then, a current flowing through the NL transistor 501 also increases, and the current flowing through the NMOS transistor 21 having the current mirror connection therewith also increases. When the current flows through the NMOS transistor 21, the current also flows through the PMOS transistor 22, and the current also flows through the PMOS transistor 23 having the current mirror connection therewith. In this way, the gate-source voltage of the output transistor 40 decreases so that the output transistor 40 approaches the OFF state. The maximum output current Im is determined based on the current flowing through the NMOS transistor 21.

The output voltage Vout decreases to be equal to or lower than the predetermined voltage Va. Then, the gate-source voltage of the NMOS transistor 31 becomes equal to or higher than its threshold voltage Vtn, and accordingly the NMOS transistor 31 is turned ON. Then, the current flowing through the PMOS transistor 22 increases to decrease the ON-state resistance of the PMOS transistor 23, which is current-mirror-connected with the PMOS transistor 22. In this way, the gate-source voltage of the output transistor 40 further decreases so that the output transistor 40 further approaches the OFF state. When the output transistor 40 further approaches the OFF state, the output current Iout reduces to be limited to the short-circuit output current Is. The short-circuit output current Is may be determined based on the current flowing through the NMOS transistor 31. After that, the output voltage Vout further decreases to approach 0 V.

The output transistor 40 and the sense transistor 11 are current-mirror-connected. In addition, the NL transistor 501, the NMOS transistor 21, and the NMOS transistor 31 are current-mirror-connected. Therefore, based on current mirror ratios of those transistors, the currents flowing through the NMOS transistor 21 and the NMOS transistor 31 may be set to have an accurate ratio with respect to the output current Iout. The maximum output current Im and the short-circuit output current Is are respectively determined based on the currents flowing through the NMOS transistor 21 and the NMOS transistor 31. Therefore, the maximum output current Im and the short-circuit output current Is may be set to have an accurate ratio with respect to the output current Iout.

Besides, because the PMOS transistors 32 and 33 are eliminated, the voltage regulator may further be reduced in size.

Figure 7:
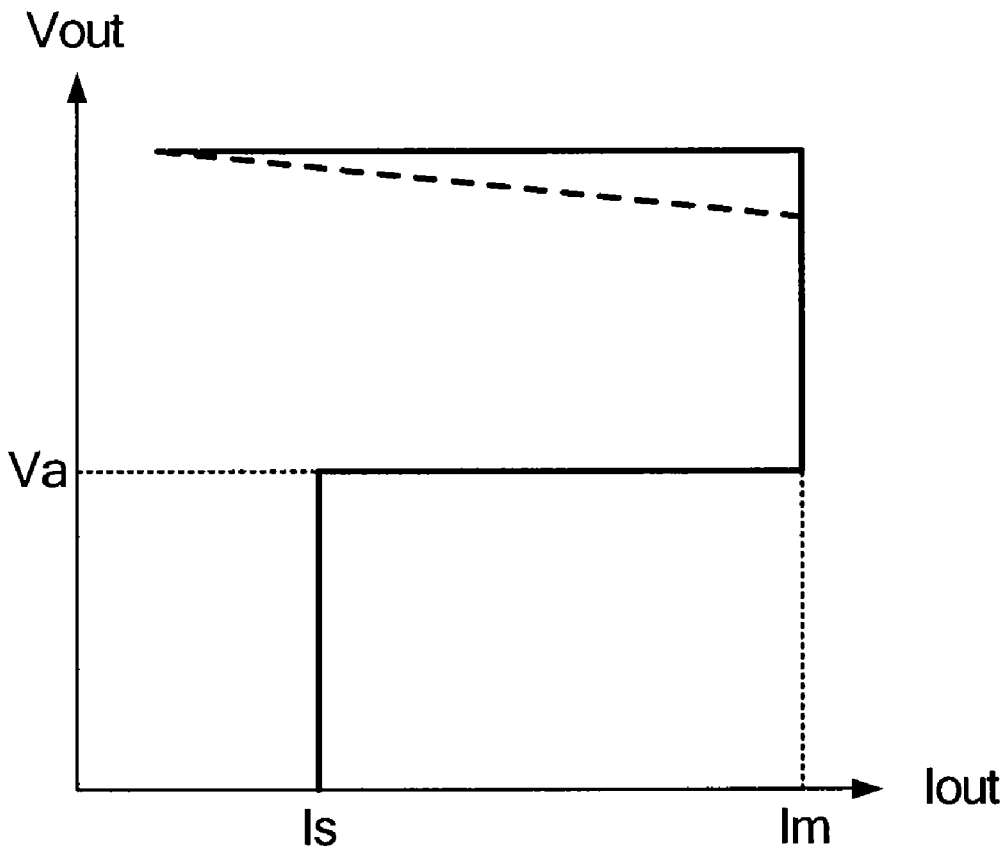
FIG. 7 is a graph illustrating output voltage-output current characteristics of the voltage regulator according to the third embodiment.

The NL transistor 501 is used to prevent the output voltage from decreasing before the output current Iout becomes the maximum output current Im. If the output terminal and the ground terminal are short-circuited to increase the output current Iout, the current is sensed by the sense transistor 11, and the output transistor 40 is caused to approach the OFF state. On this occasion, even if the output current Iout is smaller than the maximum output current Im, the sense transistor 11 accurately detects the current and allows the current to flow through the PMOS transistor 23. For this reason, as indicated as a dotted line of FIG. 7, the operation starts to turn OFF the output transistor 40 before the output current Iout reaches the maximum output current Im, and accordingly the output voltage decreases. In order to prevent the decrease, a difference in threshold is provided between the NL transistor 501 and the NMOS transistor 21 to shift the mirror ratio, to thereby disable the operation in the case where the output current Iout is smaller than the maximum output current Im.

Note that, although not illustrated, an NMOS transistor may be used as the NL transistor 501.

As described above, according to the voltage regulator of the third embodiment, the maximum output current Im and the short-circuit output current Is may be set and adjusted based on the currents flowing through the NMOS transistor 21 and the NMOS transistor 31, respectively. Besides, because the number of transistors is reduced, the voltage regulator may be realized in a further reduced size.

Fourth Embodiment

Figure 6:
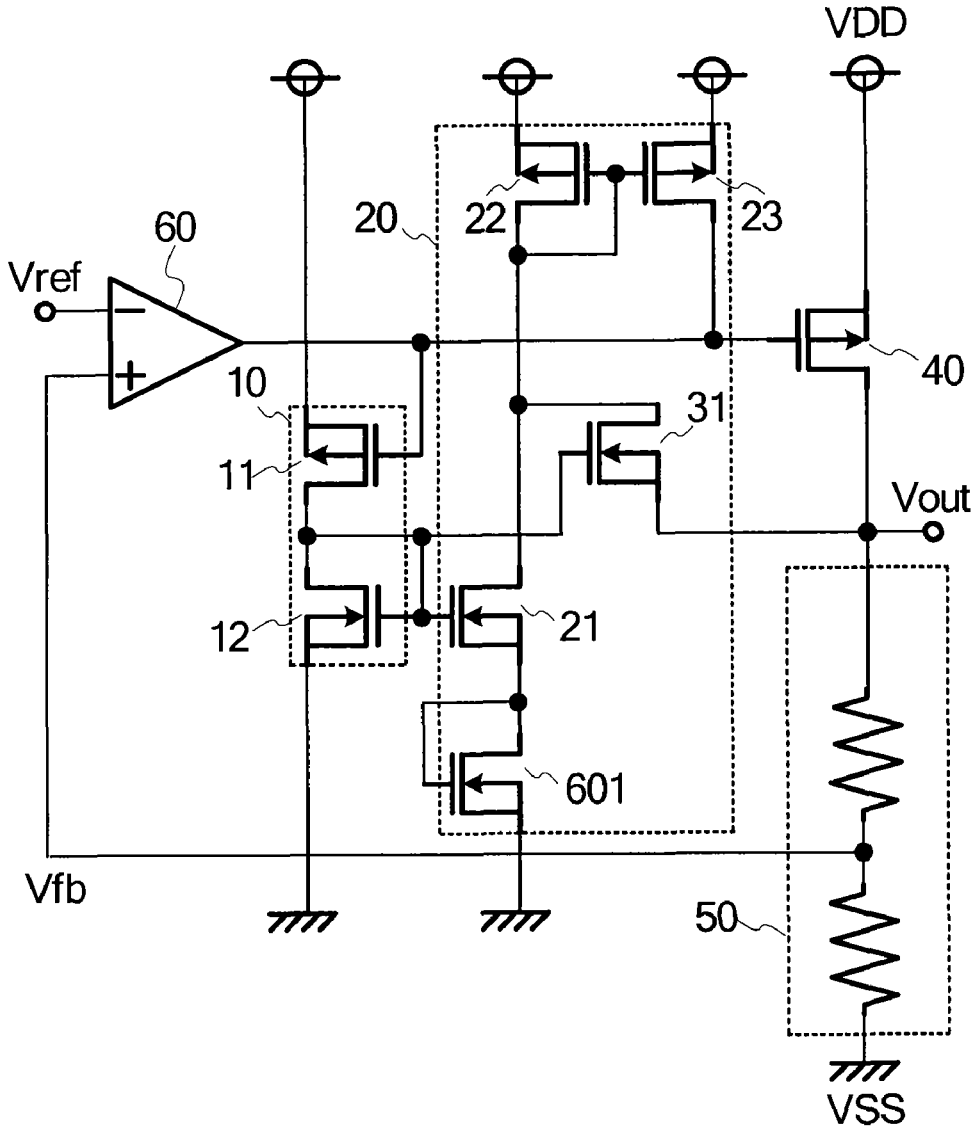
FIG. 6 is a circuit diagram illustrating a voltage regulator according to a fourth embodiment of the present invention.

FIG. 6 is a circuit diagram illustrating a voltage regulator according to a fourth embodiment of the present invention.

A difference from FIG. 1 resides in that the PMOS transistors 32 and 33 are eliminated while an NMOS transistor 601 is added. Connection is made such that a gate and a drain of the NMOS transistor 601 are connected to the source of the NMOS transistor 21, and a source thereof is connected to the ground terminal.

Next, an operation of the voltage regulator according to the fourth embodiment is described.

Because the NMOS transistor 601 is additionally connected to the source of the NMOS transistor 21, the mirror ratio between the NMOS transistor 12 and the NMOS transistor 21 may be shifted. Shifting the mirror ratio therebetween prevents the output voltage from decreasing in the case where the output current Iout is smaller than the maximum output current Im. Besides, because the NL transistor is not used, a masking step and the like for the NL transistor may be eliminated to reduce a manufacturing cost.

Further, although not illustrated, in order to further shift the mirror ratio, an NL transistor may be used as the NMOS transistor 12.

As described above, according to the voltage regulator of the fourth embodiment, the maximum output current Im and the short-circuit output current Is may be set and adjusted based on the currents flowing through the NMOS transistor 21 and the NMOS transistor 31, respectively. Besides, because the mirror ratio between the NMOS transistor 12 and the NMOS transistor 21 is shifted without using an NL transistor, a manufacturing cost may be reduced.

What is claimed is:

1. A voltage regulator for outputting a constant output voltage from an output terminal, comprising:

an amplifier;

an output transistor;

a sense transistor;

a first control circuit; and a second control circuit, the amplifier making a comparison between a reference voltage and a voltage based on the output voltage, and controlling a gate voltage of the output transistor so that the output voltage becomes constant, the output transistor outputting the output voltage based on an output signal of the amplifier and a power supply voltage, the sense transistor being current-mirror-connected with the output transistor, for sensing an output current of the output transistor, the first control circuit comprising:

a second transistor which is current-mirror-connected with a first transistor, the first transistor allowing a current to flow through the sense transistor, wherein the second transistor has a source connected to a ground terminal;

a bias current source;

a third transistor having a forward diode connection, the third transistor being provided between a power supply termnal and the bias current source;

a fourth transistor which is current-mirror-connected with the third transistor; and a fifth transistor having a gate connected to a drain of the fourth transistor, and the first control circuit operating so that, when the output current becomes a maximum output current, the output transistor approaches an OFF state, based on a current flowing through the second transistor, the second control circuit comprising a sixth transistor which is current-mirror-connected with the first transistor, the second control circuit operating so that, when the output current becomes the maximum output current and the output voltage becomes equal to or lower than a predetermined voltage, the output transistor further approaches the OFF state in order that the output current becomes a short-circuit output current, based on a current flowing through the sixth transistor.

2. A voltage regulator for outputting a constant output voltage from an output terminal, comprising:

an amplifier;

an output transistor;

a sense transistor;

a first control circuit; and a second control circuit, the amplifier making a comparison between a reference voltage and a voltage based on the output voltage, and controlling a gate voltage of the output transistor so that the output voltage becomes constant, the output transistor outputting the output voltage based on an output signal of the amplifier and a power supply voltage, the sense transistor being current-mirror-connected with the output transistor, for sensing an output current of the output transistor, the first control circuit comprising:

a second transistor which is current-mirror-connected with a first transistor, the first transistor allowing a current to flow through the sense transistor, wherein the second transistor has a source connected to a ground terminal;

a third transistor having a forward diode connection, the third transistor being provided between a power supply terminal and the second transistor; and a fourth transistor which is current-mirror-connected with the third transistor, the first control circuit operating so that, when the output current becomes a maximum output current, the output transistor a approaches an OFF state, based on a current flowing through the second transistor, the second control circuit comprising a fifth transistor which is current-mirror-connected with the first transistor, wherein the second control circuit comprises:

a fifth transistor which is current-mirror-connected with the first transistor, a sixth transistor having a forward diode connection, the sixth transistor being provided between the power supply terminal and the fifth transistor; and a seventh transistor which is current-mirror-connected with the sixth transistor, and wherein the fifth transistor has a source connected to the output terminal, and the second control circuit operating so that, when the output current becomes the maximum output current and the output voltage becomes equal to or lower than a predetermined voltage, the output transistor further approaches the OFF state in order that the output current becomes a short-circuit output current based on a current flowing through the fifth transistor.

3. A voltage regulator for outputting a constant output voltage from an output terminal, comprising:

an amplifier;

an output transistor;

a sense transistor;

a first control circuit; and a second control circuit, the amplifier making comparison between a reference voltage and a voltage based on the output voltage, and controlling a gate voltage of the output transistor so that the output voltage becomes constant, the output transistor outputting the output voltage based on an output signal of the amplifier and a power supply voltage, the sense transistor being current-mirror-connected with the output transistor, for sensing an output current of the output transistor, the first control circuit comprising:

a second transistor which is current-mirror-connected with a first transistor, the first transistor allowing a current to flow through the sense transistor, wherein the second transistor has a source connected to a ground terminal;

a third transistor having a gate applied with a voltage for operating in a linear region, the third transistor being provided between a power supply terminal and the second transistor; and a fourth transistor having a gate connected with a drain of the third transistor, the first control circuit operating so that, when the output current becomes a maximum output current, the output transistor approaches an OFF state, based on a current flowing through the second transistor, wherein the second control circuit comprises:

a fifth transistor which is current-mirror-connected with the first transistor, a sixth transistor having a gate applied with a voltage for operating in a linear region, the sixth transistor being provided between the power supply terminal and the fifth transistor; and a seventh transistor having a gate connected with a drain of the sixth transistor, and wherein the fifth transistor has a source connected to the output terminal, and the second control circuit operating so that, when the output current becomes the maximum output current and the output voltage becomes equal to or lower than a predetermined voltage the output transistor further a approaches the OFF state in order that the output current becomes a short-circuit output current, based on a current flowing through the fifth transistor.

4. A voltage regulator for outputting a constant output voltage from an output terminal, comprising:

an amplifier;

an output transistor;

a sense transistor; and a control circuit, the amplifier making a comparison between a reference voltage and a voltage based on the output voltage, and controlling a gate voltage of the output transistor so that the output voltage becomes constant, the output transistor outputting the output voltage based on an output signal of the amplifier and a power supply voltage, the sense transistor being current-mirror-connected with the output transistor, for sensing an output current of the output transistor, the control circuit comprising:

a second transistor which is current-mirror-connected with a first transistor, the first transistor allowing a current to flow through the sense transistor; and a third transistor which is current-mirror-connected with the first transistor, wherein the third transistor comprises a drain connected to a drain of the second transistor;

the control circuit being configured to:

operate so that, when the output current becomes a maximum output current, the output transistor approaches an OFF state, based on a current flowing through the second transistor; and operate so that, when the output current becomes the maximum output current and the output voltage becomes equal to or lower than a predetermined voltage, the output transistor further approaches the OFF state in order that the output current becomes a short-circuit output current, based on a current flowing through the third transistor.

5. A voltage regulator according to claim 4, wherein the first transistor comprises a transistor having a threshold lower than a threshold of the second transistor.

6. A voltage regulator according to claim 4, further comprising a fourth transistor having a forward diode connection, the tenth transistor being provided between a ground terminal and the second transistor.

7. A voltage regulator according to claim 5, further comprising a fourth transistor having a forward diode connection, the tenth transistor being provided between a ground terminal and the second transistor.

8. A voltage regulator for outputting a constant output voltage from an output terminal, comprising:

an amplifier;

an output transistor comprising a gate connected with an output of the amplifier and a drain connected with the output terminal;

a sense circuit comprising:

a sense transistor; and a first transistor connected to the sense transistor such that the first transistor allows a current to flow through the sense transistor;

a first control circuit comprising:

a second transistor connected with the first transistor in a current mirror configuration;

a third transistor connected between a power supply terminal and the second transistor; and a fourth transistor connected with the third transistor in a current mirror configuration; and a second control circuit comprising:

a fifth transistor connected with the first transistor in a current mirror configuration, the fifth transistor comprising a source connected to the output terminal;

a sixth transistor connected between the power supply terminal and the fifth transistor; and a seventh transistor comprising a gate connected with a drain of the sixth transistor.

* * * * *